US006091190A

United States Patent [19]

Chalamala et al.

[11] Patent Number: 6,091,190

[45] Date of Patent: Jul. 18, 2000

[54] FIELD EMISSION DEVICE

[75] Inventors: Babu R. Chalamala, Chandler; Sung P. Pack; Charles A. Rowell, both of Tempe, all of Ariz.

[73] Assignee: Motorola, Inc., Schaumburg, Ill.

[21] Appl. No.: 08/901,734

[22] Filed: Jul. 28, 1997

[51] Int. Cl.[7] ..... H01J 1/30

[52] U.S. Cl. ..... 313/346 R; 313/308; 313/633; 313/309; 313/311; 313/336

[58] Field of Search ..... 313/346 R, 308, 313/309, 310, 311, 336, 351, 495, 496, 497

[56] References Cited

U.S. PATENT DOCUMENTS

| | | | |
|---|---|---|---|
| 4,008,412 | 2/1977 | Yuito et al. . | |
| 4,325,000 | 4/1982 | Wolfe et al. . | |
| 4,379,250 | 4/1983 | Hosoki et al. . | |
| 4,663,559 | 5/1987 | Christensen | 313/336 X |
| 5,089,292 | 2/1992 | MaCaulay et al. . | |
| 5,129,850 | 7/1992 | Kane et al. . | |
| 5,141,460 | 8/1992 | Jaskie et al. . | |
| 5,258,685 | 11/1993 | Jaskie et al. . | |
| 5,401,676 | 3/1995 | Lee | 313/311 X |
| 5,469,014 | 11/1995 | Itoh et al. | 313/311 X |

FOREIGN PATENT DOCUMENTS

| | | |
|---|---|---|
| 0434330 | 12/1989 | European Pat. Off. . |
| 0718863 | 12/1992 | European Pat. Off. . |
| 9705639 | 2/1997 | WIPO . |

OTHER PUBLICATIONS

"Energy Distributions of Field Emitted Electrons from Carbide Tips and Tungsten Tips with Diamondlike Carbon Coatings" by Yu et al., *J. Vac. Sci. Technol.* B 14(6), Dec. 1996, pp. 3797–3801.

"Cesiated Thin–film Field–emission Microcathode Arrays" by Macaulay et al., *Appl. Phys. Lett.* 61 (8), Aug. 24, 1992, pp. 997–999.

"Electron Emission Enhancement by Overcoating Molybdenum Field–emitter Arrays with Titanium, Zirconium, and Hafnium" by Schwoebel et al., *J. Vac. Sci. Technol.* B 13(2), Apr. 1995, pp. 338–343.

"Enhancement of Electron Emission Efficiency and Stability of Molybdenum–tip Field Emitter Array by Diamond Like Carbon Coating" by Jae Hoon Jung et al., *IEEE Electron Device Letters*, vol. 18, No. 5, May 1997, pp. 197–199.

"Field Emission from ZrC films on Si and Mo Single Emitters and Emitter Arrays" by Xie et al., *J. Vac. Sci. Technol.* B 14(3), Jun. 1996, pp. 2090–2092.

"Hafnium Carbide Films and Film Coated Emission Cathodes" by Mackie et al., 9$^{th}$ International Vacuum Microelectronics Conference, St. Petersburg 1996, pp. 240–244.

Article entitled "Stability of the field emission of fine–tip cathodes passivated by transition–metal films", by E.I. Davydova, vol. 49, No. 11 (Nov. 1979).

Article entitled "Cesiated Thin–Film Field–Emission Microcathode Arrays", by J.M. Macaulay et al., vol. 61, No. 8 (Aug. 2, 1992).

*Primary Examiner*—Ashok Patel
*Attorney, Agent, or Firm*—Jasper W. Dockrey; S. Kevin Pickens; Kevin D. Wills

[57] ABSTRACT

An electron emitter (121, 221, 321, 421) includes an electron emitter structure (118) having a passivation layer (120, 220, 320, 420) formed thereon. The passivation layer (120, 220, 320, 420) is made from an oxide selected from a group consisting of the oxides of Ba, Ca, Sr, In, Sc, Ti, Ir, Co, Sr, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof. In the preferred embodiment, the electron emitter structure (118) is made from molybdenum, and the passivation layer (120, 220, 320, 420) is made from an emission-enhancing oxide having a work function that is less than the work function of the molybdenum.

19 Claims, 2 Drawing Sheets

FIELD EMISSION DEVICE

FIELD OF THE INVENTION

The present invention pertains to the area of field emission devices and, more particularly, to coatings applied to the surfaces of the electron emitter structures of field emission devices.

BACKGROUND OF THE INVENTION

It is known in the prior art to form emission-enhancing coatings on the surfaces of electron emitter structures of field emission devices. These prior art coatings are employed to improve the emission current characteristics of the field emission device. Typically, the electron emitter structures are Spindt-tip structures made from molybdenum, and the emission-enhancing coating is a metal that is selected for its low work function, which is less than that of the molybdenum. The surface work function of molybdenum is about 4.6 eV. Processes for forming electron emitter structures, such as Spindt tips, from molybdenum are well known in the art.

Prior art emission-enhancing coatings are known to be made from a pure metal selected from the following: sodium, calcium, barium, cesium, titanium, zirconium, hafnium, platinum, silver, and gold. Also known are emission-enhancing coatings made from the carbides of hafnium and zirconium. These prior art coatings are known to improve the emission current characteristics of field emission electron emitters.

However, these prior art coatings suffer from several disadvantages. For example, many of the prior art coatings, such as those made from the alkali and alkaline earth metals, are extremely reactive with respect to certain gaseous species, such as oxygen-containing species, that are present within the field emission device. Many of the prior art coatings are susceptible to oxidation during the operation of the device, resulting in emission instabilities. The alkali and alkaline earth metals also have high surface diffusion coefficients. Thus, subsequent to their deposition, these species do not remain stationary on the surface of the electron emitter structure. These characteristics of high reactivity and surface mobility result in emission current instabilities, poor device lifetime, and stringent vacuum requirements.

It is also known in the art to coat electron emitters with films made from diamond-like carbon. This prior art coating is similarly employed for the purpose of reducing the work function of the surface of the electron emitters.

When the electron emitter structures are made from a metal and do not have an emission-enhancing coating formed thereon, the surfaces of the electron emitter structures react with oxygen-containing, gaseous species contained within the device, thereby transforming the surfaces of the electron emitter structures to an oxide of the metal. Typically, water vapor, oxygen, carbon dioxide, and carbon monoxide are present in amounts sufficient to cause appreciable oxidation of the molybdenum emitter surfaces during the operation of the device. The changing characteristics of the surfaces of the electron emitter structures result in emission current instabilities. Further, molybdenum oxide, the oxide of the metal from which electron emitter structures are typically made, has a work function that is greater than that of pure molybdenum, resulting in electron emission characteristics that are inferior to those of the pure molybdenum surface.

Accordingly, there exists a need for an improved field emission device having electron emitters that are resistant to oxidation during the operation of the device and that have surface work functions that are less than or equal to that of the metal from which the electron emitter structures are made.

Figure 1:
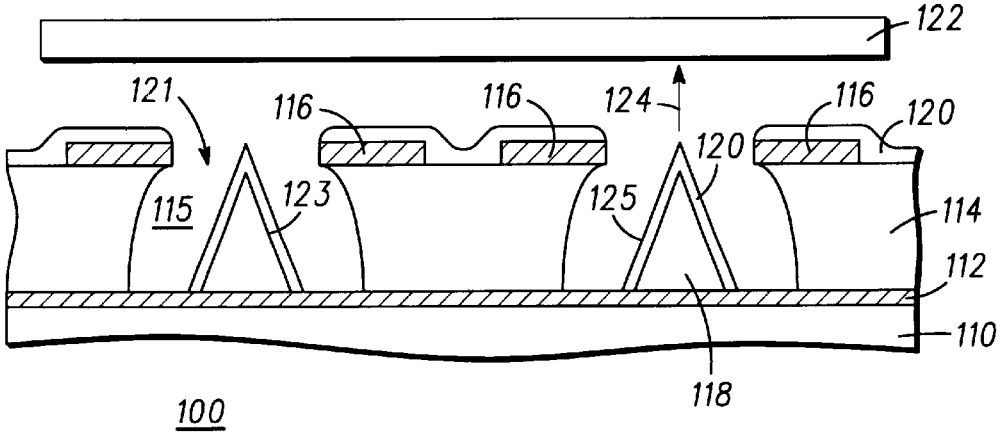
FIG.1 is a cross-sectional view of a first embodiment of a field emission device in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a field emission device having electron emitter structures that are coated with a passivation layer. The passivation layer is chemically and thermodynamically more stable than prior art coatings. For example, the passivation layer is resistant to oxidation during the operation of the field emission device. The passivation layer is preferably made from an oxide. Most preferably, the oxide has a work function that is less than or equal to the work function of the electron emitter structure.

The passivation layer is preferably made from an oxide being selected from a group consisting of the oxides of Ba, Ca, In, Sc, Ti, Ir, Co, Sr, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof. Exemplary oxides for use in the passivation layer of an electron emitter of the invention are: BaO, $Ba_3WO_6$, CaO, SrO, $In_2O_3$, $Sc_2O_3$, TiO, $IrO_2$, $Y_2O_3$, $ZrO_2$, $RuO_2$, PdO, $SnO_2$, $Lu_2O_3$, $HfO_2$, $ReO_3$, $La_2O_3$, $Ce_2O_3$, $Pr_2O_3$, $Nd_2O_3$, $Pm_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $ThO_2$, $In_2O_3{:}SnO_2$, $BaTiO_3$, $BaCuO_x$, $xBaO.HfO_2$, $Bi_2Sr_2CaCu_2O_x$, $YBa_2Cu_3O_{7-x}$, $SrRuO_3$, (Ba,Sr)O, (La,Sr)$CoO_3$, and $(BaO)_n.(Ta_2O_3)_m$, where x, n, and m are integers.

A field emission device of the invention provides more stable electron emission, a longer device lifetime, a lower operating voltage for a specified emission current, reduced shorting problems between individual gate electrodes and between gate electrodes and cathode electrodes, and less stringent vacuum requirements than prior art field emission devices.

FIG. 1 is a cross-sectional view of a field emission device (FED) 100 configured in accordance with the invention. FED 100 includes a substrate 110, which is made from a hard material, such as glass, quartz, and the like. A cathode 112 is disposed on substrate 110 and is made from a conductive material, such as molybdenum, aluminum, and the like. Cathode 112 is formed using a convenient deposition process, such as sputtering, electron beam evaporation, and the like. A dielectric layer 114 is formed on cathode 112 using standard deposition techniques, such as plasma-enhanced chemical vapor deposition. Dielectric layer 114 is made from a dielectric material, such as silicon dioxide, silicon nitride, and the like. A plurality of emitter wells 115 is formed within dielectric layer 114 by a convenient etching process. An electron emitter structure 118 is formed within each of emitter wells 115. In the preferred embodiment, electron emitter structure 118 has a conical shape, and may include a Spindt tip made from molybdenum. Methods for making electron emitter structure 118 are known to one skilled in the art. FED 100 further includes a plurality of gate electrodes 116, which are made from a conductive material, such as molybdenum, aluminum, and the like. Gate electrodes 116 are patterned to provide selective addressability of electron emitter structures 118. FED 100 also includes an anode 122, which is spaced from electron emitter structures 118 and is designed to receive electrons emitted therefrom.

In accordance with the invention, FED 100 has a passivation layer 120, which is disposed on electron emitter structures 118, gate electrodes 116, and dielectric layer 114. An electron emitter 121 is defined by electron emitter structure 118 and the portion of passivation layer 120 that is formed thereon.

Passivation layer 120 is made from a material that is chemically and thermodynamically stable within the vacuum environment of FED 100. The chemical and thermodynamic stability of passivation layer 120 provides stable electron emission from electron emitter 121. In particular, passivation layer 120 is chemically and thermodynamically more stable than electron emitter structure 118. For example, passivation layer 120 is resistant to oxidation during the operation of FED 100. In particular, passivation layer 120 has a greater resistance to oxidation than the material comprising electron emitter structures 118. Most preferably, passivation layer 120 is made from a material having a work function that is less than the work function of the material from which electron emitter structures 118 are made.

Also, in the embodiment of FIG. 1, passivation layer 120 has an electrical resistance that is high enough to avoid electrical shorting between gate electrodes 116. Thus, passivation layer 120 can be made from an oxide that has a high resistivity, such as the lanthanide oxides. Additionally, passivation layer 120 can be made from a conductive oxide if passivation layer 120 is made very thin (a monolayer to about 100 nanometers), so that the sheet resistance is high enough to mitigate electrical shorting problems between gate electrodes 116.

As described above, a passivation layer in accordance with the invention is preferably made from an oxide. Most preferably, it is made from an oxide that has a surface work function that is less than that of the material from which electron emitter structure 118 is made. In the preferred embodiment of the invention, electron emitter structure 118 is made from molybdenum, which has a surface work function of about 4.6 eV.

Table 1 below tabulates representative values of the work functions of selected oxides, which are contemplated for use in a passivation layer in accordance with the invention. The work function data of Table 1 is extracted from the *Handbook of Thermionic Properties* by V. S. Fomenko, Plenum Press, New York, 1966. The work function of a particular surface depends, in part, upon the configuration of the lattice plane at the emissive surface. Thus, some of the oxides listed in Table 1 have corresponding thereto several values for the work function.

TABLE 1

Work Functions of Selected Oxides for the Passivation Layer of the Invention

| Oxide of Passivation Layer | Work Function (eV) | Oxide of Passivation Layer | Work Function (eV) |
|---|---|---|---|
| BaO | 1.0–1.7 | $Pm_2O_3$ | 3.3 |
| $Ba_3WO_6$ | 2.4–2.8 | $Eu_2O_3$ | 2.6–3.6 |
| SrO | 1.2–2.6 | $Gd_2O_3$ | 2.1–3.1 |
| $Sc_2O_3$ | 4.4 | $Tb_2O_3$ | 2.1, 2.3, 2.9, 3.3 |
| TiO | 2.96–3.1 | $Dy_2O_3$ | 2.1–3.2 |
| $Y_2O_3$ | 2.0–3.87 | $Ho_2O_3$ | 2.3–3.2 |
| $ZrO_2$ | 3.1–4.1 | $Er_2O_3$ | 2.4–3.3 |
| $Lu_2O_3$ | 2.3–3.86 | $Tm_2O_3$ | 3.27 |
| $HfO_2$ | 2.8, 3.6, 3.8 | $Yb_2O_3$ | 2.7–3.39 |
| $La_2O_3$ | 2.8–3.81 | $ThO_2$ | 1.6–3.7 |
| $Ce_2O_3$ | 3.21, 4.20 | $xBaO.HfO_2$ | 2.1–2.2 |
| $Pr_2O_3$ | 2.8, 3.48, 3.68 | (Ba,Sr)O | 1.2 |
| $Nd_2O_3$ | 2.3–3.3 | $(BaO)_n.(Ta_2O_3)_m$ | 2.3–3.9 |

As indicated in Table 1, the oxides of the lanthanide rare earth elements ($La_2O_3$, $Ce_2O_3$, $Pr_2O_3$, etc.) have surface work functions that are less than that of molybdenum. These oxides also have resistivities that are high enough to prevent electrical shorting between gate electrodes 116. Thus, they are suitable for use in passivation layer 120.

Passivation layer 120 may be realized by performing a blanket, normal (90° with respect to the plane of the cathode plate) deposition of the oxide from the gas phase. This method is useful for oxides that can be deposited using standard vapor deposition techniques, such as evaporation, electron beam evaporation, sputtering, plasma-enhanced chemical vapor deposition, and the like.

Figure 4:
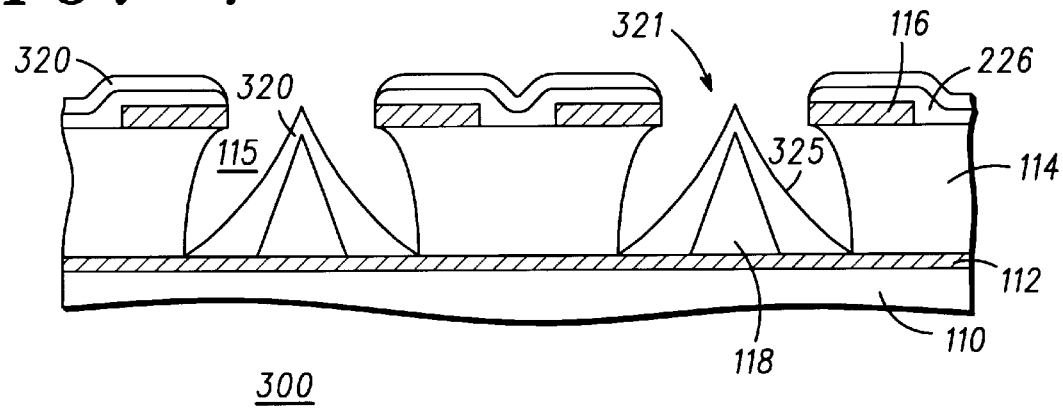
FIG. 4 is a cross-sectional view of a third embodiment of a field emission device in accordance with the invention.
Figure 5:
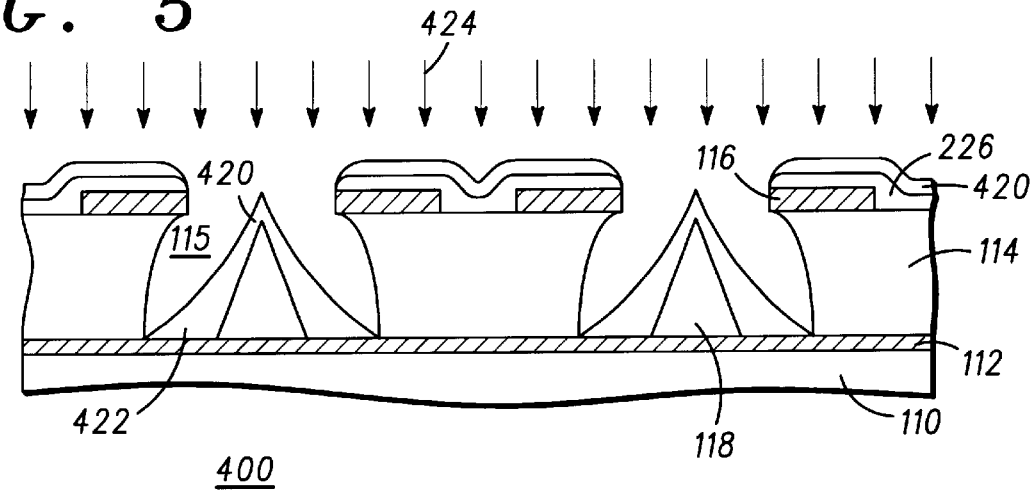
FIGS. 5 and 6 are cross-sectional views of a fourth embodiment of a field emission device in accordance with the invention.
Figure 6:
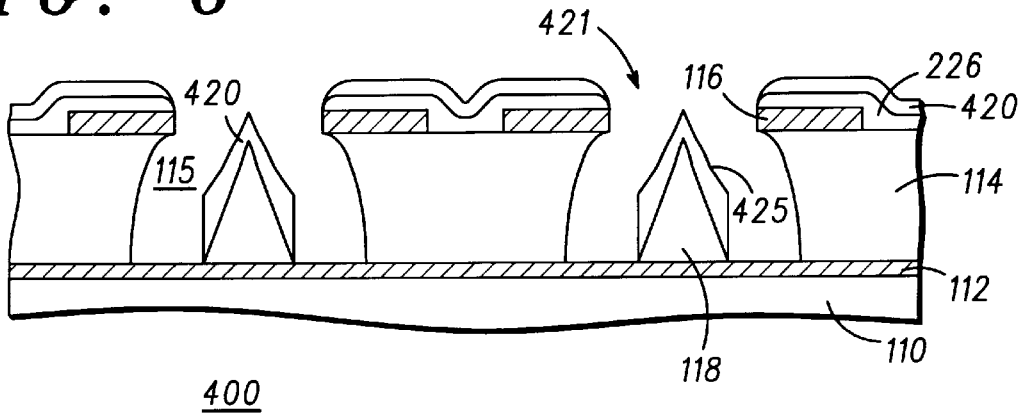

Passivation layer 120 may also be deposited using a liquid carrier, as is described in greater detail with reference to FIGS. 4–6. In this particular method, the oxide is dispersed into the liquid carrier to form a liquid mixture. The liquid mixture is deposited onto the surface of the cathode plate, thereby coating electron emitter structures 118 and the surfaces of gate electrodes 116 and dielectric 114. The liquid carrier is then selectively removed. In a variation of this method, an organometallic precursor, which contains the metallic element of the oxide, may be employed. The organometallic precursor is dispersed into the liquid carrier, and converted to the oxide during a plasma ashing step, which is utilized to selectively remove the liquid carrier. No sacrificial layer, which is described with respect to FIGS. 4–6, is required in the fabrication of the embodiment of FIG. 1.

The thickness of a passivation layer in accordance with the invention is predetermined to provide electron emission from a selected surface. In general, thinner films can be employed to enhance electron emission from a surface 123 of electron emitter structure 118. For example, a thin film can include one monolayer of material. Thicker films can be employed to provide electron emission from the passivation layer. Such thick films define the surface of the electron emitter, and electrons are emitted from this surface. In the embodiment of FIG. 1, passivation layer 120 has a thickness that is preferably between 50–500 angstroms, so that a surface 125 of electron emitter 121 is defined by passivation layer 120.

FED 100 is operated by applying to cathode 112, gate electrodes 116, and anode 122 predetermined potentials suitable for effecting electron emission, which is indicated by an arrow 124 in FIG. 1, from electron emitters 121. An electron emitter in accordance with the invention is also contemplated for use in field emission devices having electrode configurations other than a triode configuration. For example, the electron emitter of the invention can be employed in a diode field emission device, or in devices having additional focusing electrodes.

Figure 2:
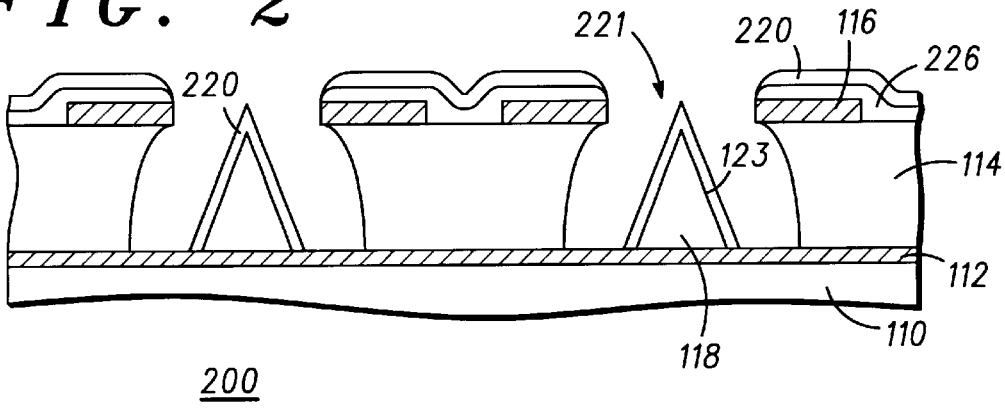
FIGS. 2 and 3 are cross-sectional views of a second embodiment of a field emission device in accordance with the invention.
Figure 3:
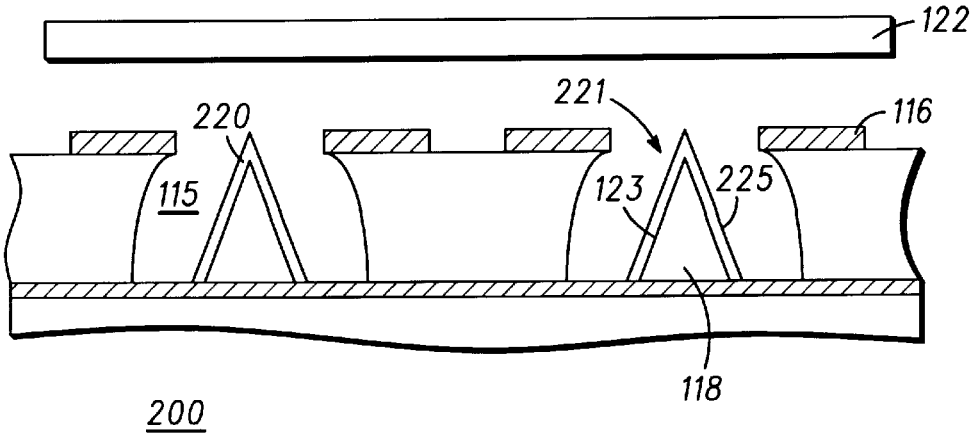

In a second embodiment of a field emission device in accordance with the invention, the passivation layer is disposed on electron emitter structures 118; none of the passivation layer is disposed between gate electrodes 116. This particular configuration is depicted in FIGS. 2 and 3. It is particularly useful for oxides that have resistivities that are lower than those of the oxides contemplated for use in the embodiment of FIG. 1. By selectively depositing the passivation layer onto electron emitter structures 118, electrical shorting between gate electrodes 116 is avoided.

FIGS. 2 and 3 are cross-sectional views of a field emission device (FED) 200 in accordance with the invention. FED 200, as depicted in FIG. 3, includes a passivation layer 220, which is disposed only on surfaces 123 of electron emitter structures 118. The configuration of FIG. 3 is particularly useful for thicker (greater than about 100 nanometers) passivation layers, which are made from conductive oxides.

As illustrated in FIG. 2, FED 200 can be made by first forming a sacrificial layer 226 on gate electrodes 116 and dielectric layer 114. Sacrificial layer 226 is made from a sacrificial material, which is capable of being selectively removed subsequent to the deposition of passivation layer 220. Sacrificial layer 226 is preferably made from a metal selected from a group consisting of aluminum, zinc, copper, tin, titanium, vanadium, and silver.

Sacrificial layer 226 is formed by employing an angled deposition, to mitigate deposition of the sacrificial material onto the walls of emitter well 115 and surfaces 123.

After the formation of sacrificial layer 226, passivation layer 220 is deposited onto the cathode plate by performing a blanket, normal (90° with respect to the plane of the cathode plate) deposition of the oxide from the gas phase. This method is useful for oxides that can be deposited using standard vapor deposition techniques, such as evaporation, electron beam evaporation, sputtering, plasma-enhanced chemical vapor deposition, and the like.

In the preferred embodiment, the thickness of passivation layer 220 is within a range of about 50–500 angstroms, so that a surface 225 is defined by the oxide of passivation layer 220, and so that electron emission is from passivation layer 220. The combination of electron emitter structure 118 and that portion of passivation layer 220 disposed thereon defines an electron emitter 221.

Subsequent to the deposition of passivation layer 220, sacrificial layer 226 is selectively removed, as by a convenient selective etch process. Then, anode 122 is assembled with the cathode plate, as depicted in FIG. 3. Exemplary conductive oxides that are preferably deposited by the method described with reference to FIGS. 2 and 3 are $In_2O_3$, $IrO_2$, $RuO_2$, PdO, $SnO_2$, $ReO_3$, $In_2O_3$:$SnO_2$, $BaTiO_3$, $BaCuO_x$, $Bi_2Sr_2CaCu_2O_x$, $YBa_2Cu_3O_{7-x}$, $SrRuO_3$, where x is an integer.

Some of the oxides contemplated for use in the passivation layer of an electron emitter of the invention are not conveniently deposited by standard vapor deposition techniques. These oxides include, but are not limited to, $RuO_2$ and $ReO_3$. Methods that are particularly useful for the deposition of these types of oxides are described below with reference to FIGS. 4–6.

FIG. 4 depicts a structure formed in the fabrication of a FED 300, which is configured in accordance with the invention. The emission-enhancing oxide or a precursor thereof is first dispersed within a liquid carrier. In this example, the liquid carrier is an organic spreading liquid medium. The organic spreading liquid medium is a liquid organic material, such as an alcohol, acetone, or other organic solvent, which is capable of being selectively removed from a passivation layer 320 subsequent to its deposition onto the cathode plate.

After the emission-enhancing oxide or precursor thereof is dispersed within the organic spreading liquid medium, the liquid mixture is applied to the surface of the cathode plate by a convenient deposition method, such as roll-coating, spin-on coating, and the like. During this deposition step, the liquid mixture coats electron emitter structures 118 and sacrificial layer 226.

Subsequent to the deposition of passivation layer 320, the organic spreading liquid medium is removed therefrom. The removal of the organic spreading liquid medium is achieved by an ashing procedure, which includes the step of burning the organic spreading liquid medium by exposure to a plasma. In this manner an electron emitter 321, which includes electron emitter structure 118 and the coating of the emission-enhancing oxide formed thereon, is realized. After the removal of the organic spreading liquid medium, sacrificial layer 226 is selectively removed by a selective etching procedure. Then, the cathode plate is assembled with an anode (not shown).

In the example of FIG. 4, the thickness of the final, emission-enhancing coating is determined by the concentration of the emission-enhancing oxide or precursor thereof in the organic spreading liquid medium. A low concentration can be used to form a very thin coating. A very thin coating results in a surface 325 of electron emitter 321, which is defined by the oxide and electron emitter structure 118. For example, a very thin coating may include one monolayer of the emission-enhancing oxide. In the preferred embodiment, the concentration is predetermined so that the final coating is thick enough to define surface 325 of electron emitter 321. In this latter configuration, electron emission is only from the oxide coating. This configuration is particularly useful for emission-enhancing oxides having work functions that are less than that of electron emitter structure 118. The thickness of these thicker coatings is greater than about 100 angstroms.

When a precursor of an emission-enhancing oxide is used in the embodiment of FIG. 4, the precursor of the emission-enhancing oxide is converted to the corresponding emission-enhancing oxide subsequent to the deposition of the liquid mixture onto the cathode plate. An exemplary precursor is an organometallic material, the metallic chemical element of which forms an oxide that is an emission-enhancing material. The metallic chemical element of the precursor is converted to the emission-enhancing oxide during the step of removing the organic spreading liquid medium. Specifically, during the plasma ashing step, the metallic chemical element of the organometallic material is oxidized. By way of example, an organometallic precursor useful for the formation of ruthenium oxide is dodecacarbonyltriruthenium [$Ru_3(CO)_{12}$] or ruthenium(III)2,4-pentanedionate [$Ru(C_5H_7O_2)_3$]; an organometallic precursor useful for the formation of rhenium oxide is decacarbonyldirhenium [$Re_2(CO)_{10}$].

The method described with reference to FIG. 4 can also be utilized to fabricate the configuration illustrated in FIG.

1 when the resistivity of the final oxide coating is high enough to avoid electrically shorting gate electrodes 116. In this variation of the method described with reference to FIG. 4, the sacrificial layer is omitted.

Certain emission-enhancing oxides that can be deposited using a liquid carrier, such as described with reference to FIG. 4, are conductive enough to result in electrical shorting problems if they are deposited on or proximate to the surfaces of dielectric layer 114 that define emitter wells 115. These conductive emission-enhancing oxides can also be selectively deposited onto electron emitter structures 118 by a method in accordance with the invention, as described with reference to FIGS. 5 and 6.

Illustrated in FIGS. 5 and 6 are cross-sectional views of a FED 400 having a passivation layer 420, which contains a conductive emission-enhancing oxide. Passivation layer 420 is formed by first dispersing the conductive emission-enhancing oxide into a liquid, negative photoresist material. This mixture is deposited onto the cathode plate by a convenient liquid deposition method, such as roll-coating, spin-on coating, and the like. This deposition step generally coats sacrificial layer 226 and electron emitter structures 118. However, some of the deposited material may form a foot portion 422 at the base of each of emitter wells 115 and/or may be deposited along the walls defining emitter wells 115.

If they are not removed, these portions of the deposited material may result in electrical shorting problems between cathode 112 and gate electrodes 116, due to the relatively low resistivity of the conductive emission-enhancing oxide. These portions of the deposited material can be removed by first photo-exposing the cathode plate to collimated UV light, which is directed toward the cathode plate in a direction generally normal to the plane of the cathode plate. The collimated UV light is indicated by a plurality of arrows 424 in FIG. 5. During the photo-exposure step, the upper protruding portion of the structure defining each of emitter wells 115 masks from the UV light foot portion 422 and any material deposited on the walls of emitter wells 115.

After the photo-exposure step, passivation layer 420 is developed, thereby removing the portions of passivation layer 420 that were not photo-exposed, as illustrated in FIG. 6. Then, the negative resist is removed from passivation layer 420, as by plasma ashing. In this manner an electron emitter 421, which includes electron emitter structure 118 and the emission-enhancing oxide formed thereon, is realized. After the removal of the negative photoresist, sacrificial layer 226 is removed. Subsequent to the removal of sacrificial layer 226, the cathode plate is assembled with an anode (not shown). Examples of conductive emission-enhancing oxides that can be deposited in the manner described with reference to FIGS. 5 and 6 include $RuO_2$, PdO, $SnO_2$, $ReO_3$, and $IrO_2$.

The thickness of the final configuration of passivation layer 420 is determined in a manner similar to that described with reference to FIG. 4. In the prefered embodiment, the oxide defines a surface 425 of electron emitter 421.

In summary, the invention is for a field emission device having electron emitter structures that are coated with a passivation layer, which is chemically and thermodynamically more stable than prior art coatings. The passivation layer is preferably made from an oxide selected from a group consisting of the oxides of Ba, Ca, In, Sc, Ti, Ir, Co, Sr, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof. A field emission device of the invention provides more stable electron emission, a longer device lifetime, a lower operating voltage for a specified emission current, reduced shorting problems between individual gate electrodes and between gate electrodes and cathode electrodes, and less stringent vacuum requirements than prior art field emission devices.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. An electron emitter comprising:

an electron emitter structure having a surface, wherein the electron emitter structure comprises a material having a first work function; and a passivation layer disposed on the surface of the electron emitter structure, wherein the passivation layer comprises an oxide, and wherein the oxide has a second work function, the second work function of the oxide being less than the first work function of the material comprising the electron emitter structure.

2. The electron emitter of claim 1, wherein the electron emitter has a surface, and wherein the oxide defines the surface of the electron emitter.

3. The electron emitter of claim 1, wherein the oxide is selected from a group consisting of the oxides of Ba, Ca, Sr, In, Sc, Ti, Ir, Co, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof.

4. The electron emitter of claim 3, wherein the oxide is selected from a group consisting of BaO, $Ba_3WO_6$, CaO, SrO, $In_2O_3$, $Sc_2O_3$, TiO, $IrO_2$, $Y_2O_3$, $ZrO_2$, $RuO_2$, PdO, $SnO_2$, $Lu_2O_3$, $HfO_2$, $ReO_3$, $La_2O_3$, $Ce_2O_3$, $Pr_2O_3$, $Nd_2O_3$, $Pm_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $ThO_2$, $In_2O_3$:$SnO_2$, $BaTiO_3$, $BaCuO_x$, xBaO.$HfO_2$, $Bi_2Sr_2CaCu_2O_x$, $YBa_2Cu_3O_{7-x}$, $SrRuO_3$, (Ba,Sr)O, (La,Sr)$CoO_3$, and $(BaO)_n.(Ta_2O_3)_m$, where x, n, and m are integers.

5. The electron emitter of claim 1, wherein the passivation layer consists essentially of an oxide.

6. The electron emitter of claim 5, wherein the oxide is selected from a group consisting of the oxides of Ba, Ca, Sr, In, Sc, Ti, Ir, Co, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof.

7. The electron emitter of claim 6, wherein the oxide is selected from a group consisting of BaO, $Ba_3WO_6$, CaO, SrO, $In_2O_3$, $Sc_2O_3$, TiO, $IrO_2$, $Y_2O_3$, $ZrO_2$, $RuO_2$, PdO, $SnO_2$, $Lu_2O_3$, $HfO_2$, $ReO_3$, $La_2O_3$, $Ce_2O_3$, $Pr_2O_3$, $Nd_2O_3$, $Pm_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $ThO_2$, $In_2O_3$:$SnO_2$, $BaTiO_3$, $BaCuO_x$, xBaO.$HfO_2$, $Bi_2Sr_2CaCu_2O_x$, $YBa_2Cu_3O_{7-x}$, $SrRuO_3$, (Ba,Sr)O, (La,Sr)$CoO_3$, and $(BaO)_n.(Ta_2O_3)_m$, where x, n, and m are integers.

8. The electron emitter of claim 1, wherein the electron emitter structure comprises molybdenum.

9. The electron emitter of claim 1, wherein the electron emitter structure is comprised of a material, and wherein the passivation layer has a greater resistance to oxidation than the material.

10. A field emission device comprising:

a substrate having a surface;

a cathode disposed on the surface of the substrate;

a dielectric layer disposed on the cathode and defining an emitter well;

an electron emitter structure disposed within the emitter well and having a surface, wherein the electron emitter structure comprises a material having a first work function;

a passivation layer disposed on the surface of the electron emitter structure to define an electron emitter, wherein the passivation layer comprises an oxide, and wherein the oxide has a second work function, the second work function of the oxide being less than the first work function of the material comprising the electron emitter structure; and an anode opposing the electron emitter.

11. The field emission device of claim 10, further including a gate electrode disposed on the dielectric layer.

12. The field emission device of claim 10, wherein the electron emitter has a surface, and wherein the oxide defines the surface of the electron emitter.

13. The field emission device of claim 10, wherein the oxide is selected from a group consisting of the oxides of Ba, Ca, Sr, In, Sc, Ti, Ir, Co, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof.

14. The field emission device of claim 13, wherein the oxide is selected from a group consisting of BaO, $Ba_3WO_6$, CaO, SrO, $In_2O_3$, $Sc_2O_3$, TiO, $IrO_2$, $Y_2O_3$, $ZrO_2$, $RuO_2$, PdO, $SnO_2$, $Lu_2O_3$, $HfO_2$, $ReO_3$, $La_2O_3$, $Ce_2O_3$, $Pr_2O_3$, $Nd_2O_3$, $Pm_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $ThO_2$, $In_2O_3$:$SnO_2$, $BaTiO_3$, $BaCuO_x$, $xBaO.HfO_2$, $Bi_2Sr_2CaCu_2O_x$, $YBa_2Cu_3O_{7-x}$, $SrRuO_3$, (Ba,Sr)O, (La,Sr)$CoO_3$, and $(BaO)_n.(Ta_2O_3)_m$, where x, n, and m are integers.

15. The field emission device (100, 200, 300, 400) of claim 10, wherein the passivation layer (120, 220, 320, 420) consists essentially of an oxide.

16. The field emission device of claim 15, wherein the oxide is selected from a group consisting of the oxides of Ba, Ca, Sr, In, Sc, Ti, Ir, Co, Y, Zr, Ru, Pd, Sn, Lu, Hf, Re, La, Ce, Pr, Nd, Pm, Sm, Eu, Gd, Tb, Dy, Ho, Er, Tm, Yb, Th, and combinations thereof.

17. The field emission device of claim 16, wherein the oxide is selected from a group consisting of BaO, $Ba_3WO_6$, CaO, SrO, $In_2O_3$, $Sc_2O_3$, TiO, $IrO_2$, $Y_2O_3$, $ZrO_2$, $RuO_2$, PdO, $SnO_2$, $Lu_2O_3$, $HfO_2$, $ReO_3$, $La_2O_3$, $Ce_2O_3$, $Pr_2O_3$, $Nd_2O_3$, $Pm_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $ThO_2$, $In_2O_3$:$SnO_2$, $BaTiO_3$, $BaCuO_x$, $xBaO.HfO_2$, $Bi_2Sr_2CaCu_2O_x$, $YBa_2Cu_3O_{7-x}$, $SrRuO_3$, (Ba,Sr)O, (La,Sr)$CoO_3$, and $(BaO)_n.(Ta_2O_3)_m$, where x, n, and m are integers.

18. The field emission device (100, 200, 300, 400) of claim 10, wherein the electron emitter structure (118) comprises molybdenum.

19. The field emission device (100, 200, 300, 400) of claim 10, wherein the electron emitter structure (118) is comprised of a material, and wherein the passivation layer (120, 220, 320, 420) has a greater resistance to oxidation than the material.

* * * * *